US009004792B2

(12) United States Patent
Wisler et al.

(10) Patent No.: US 9,004,792 B2
(45) Date of Patent: Apr. 14, 2015

(54) ERASER CAP ASSEMBLY FOR WRITING INSTRUMENT

(75) Inventors: Stephen Jacobs Wisler, Chicago, IL (US); Marc William Colavitti, Itasca, IL (US)

(73) Assignee: Sanford, L.P., Downers Grove, IL (US)

( * ) Notice: Subject to any disclaimer, the term of this patent is extended or adjusted under 35 U.S.C. 154(b) by 587 days.

(21) Appl. No.: 13/340,164

(22) Filed: Dec. 29, 2011

(65) Prior Publication Data

US 2013/0170885 A1 Jul. 4, 2013

(51) Int. Cl.

| | |
|---|---|
| ***B43K 29/02*** | (2006.01) |
| ***B43K 21/02*** | (2006.01) |
| ***B43K 29/05*** | (2006.01) |
| ***B43L 19/00*** | (2006.01) |

(52) U.S. Cl.
CPC ..... *B43L 19/0081* (2013.01); *B43K 21/02* (2013.01); *B43K 29/05* (2013.01)

(58) Field of Classification Search
USPC ..... 401/52; 15/424, 425, 426, 427, 431, 15/432, 105.51
See application file for complete search history.

(56) References Cited

U.S. PATENT DOCUMENTS

| | | | | |
|---|---|---|---|---|
| 100,189 | A | 2/1870 | Richards | |
| 126,792 | A | 5/1872 | Evans | |
| 977,762 | A | 12/1910 | Tregoning | |
| 1,914,753 | A | 6/1933 | Morrell | |
| 2,142,377 | A * | 1/1939 | Roth | 15/432 |
| 2,239,526 | A * | 4/1941 | Juelss | 15/432 |
| 2,454,399 | A * | 11/1948 | Norlin | 15/432 |
| 2,690,735 | A * | 10/1954 | Lopez | 15/432 |
| 4,221,491 | A * | 9/1980 | Ganz | 401/33 |
| 5,221,152 | A * | 6/1993 | Chuang | 401/57 |
| 2002/0110404 | A1 * | 8/2002 | Saitou | 401/244 |
| 2010/0028068 | A1 | 2/2010 | Razalan | |
| 2014/0130297 | A1 * | 5/2014 | Cochran | 15/425 |

FOREIGN PATENT DOCUMENTS

| | | | |
|---|---|---|---|
| JP | 9066697 | A | 3/1997 |
| JP | 2005161643 | A | 6/2005 |
| WO | WO-2010/024346 | A1 | 3/2010 |
| WO | WO-2010/095845 | A2 | 8/2010 |

OTHER PUBLICATIONS

Partial International Search Report from corresponding international application No. PCT/US2012/071209, mailing date Mar. 27, 2013.
Color photograph (p. 8 of 14) from "Pentel Jolt AS305 Mechanical Pencil Review", Dave's Mechanical Pencils blog, retrieved from the Internet: <http://davesmechanicalpencils.blogspot.com/2010/09/pentel-jolt-as305-mechanical-pencil.html> (Sep. 21, 2010).

(Continued)

*Primary Examiner* — David Walczak
*Assistant Examiner* — Joshua Wiljanen
(74) *Attorney, Agent, or Firm* — Marshall, Gerstein & Borun LLP

(57) ABSTRACT

An eraser assembly having at least one eraser, an eraser holder having a first rim including at least one notch, the eraser being disposed in the eraser holder and an eraser cap having at least one tab extending therefrom. The tab of the eraser cap engages the notch of the eraser holder, thereby securing the cap to the eraser holder and enclosing the eraser.

19 Claims, 4 Drawing Sheets

(56) References Cited

OTHER PUBLICATIONS

Color photograph (p. 6 of 12) from "Paper Mate Clearpoint Mechanical Pencil Review", Dave's Mechanical Pencils blog, retrieved from the Internet at: <http://davesmechanicalpencils.blogspot.com/2010/06/papermate-clearpoint-mechanical-pencil.html> (Jun. 22, 2010).

International Search Report and Written Opinion, issued Jun. 24, 2013, in corresponding International Application No. PCT/US2012/071209.

International Report on Patentability for International Application No. PCT/US2012/071209, dated Jul. 1, 2014.

Preliminary Search Report and Written Opinion, corresponding French patent application No. 1203521, mailed Sep. 30, 2014 (with English translation).

* cited by examiner

ERASER CAP ASSEMBLY FOR WRITING INSTRUMENT

FIELD OF THE DISCLOSURE

This disclosure relates generally to writing instruments, and, more particularly, to an eraser cap assembly for a writing instrument.

BACKGROUND OF THE DISCLOSURE

The useful life of a mechanical pencil is often limited by the size of its eraser. One solution is to extend the lifetime of the eraser by including a very large eraser, or a double sided eraser that can be flipped over after one side of the eraser is depleted. See, e.g., U.S. Pat. No. 1,914,753. Unfortunately, it is difficult to incorporate such erasers having extended "lifetimes" into the area of the pencil that is used as an actuator.

Another problem with erasers is that they (unfortunate)y) easily pick up and retain dirt, dust, and other surrounding particles, which can make them visually unappealing and also less capable of cleanly removing a pencil mark. This dirt problem can limit the ability of office supply stores to offer mechanical pencils in "open stock," i.e., without plastic packaging. Such methods of merchandising are advantageous, potentially increasing purchasing opportunities for the ultimate consumer by facilitating immediate testing of the product by the consumer at the point-of-sale.

This dirt problem can also cause a consumer to have an unattractive and messy looking pencil after it is initially used and/or simply stored in a desk, briefcase, or any other container or area where exposure to dirt occurs. One solution to this dirt problem is to provide a cap that is placed over the eraser. This, however, can be difficult. For example, if the cap is fitted over the eraser only, the cap may not stay in place after the eraser is diminished and changed in shape. If the cap is fitted over the eraser and a corresponding section that holds the eraser, the diameter of the cap may require the end of the mechanical pencil to be enlarged to an excessive degree, which can be unsightly especially in cases where the eraser portion acts as an actuator. In both cases, the increased diameter of the cap relative to the eraser portion can negatively affect the aesthetic of the mechanical pencil. Furthermore, it is entirely too easy to displace and lose such caps.

SUMMARY OF THE DISCLOSURE

An eraser cap assembly comprises at least one eraser, an eraser holder having a first rim including at least one notch, the eraser being disposed in the eraser holder, and an eraser cap having at least one tab extending therefrom. The tab of the eraser cap engages the notch of the eraser holder, thereby securing the cap to the eraser holder and enclosing the eraser.

The eraser holder of the eraser assembly may further include a first end, a second end disposed opposite the first end, a first receptacle housing a first eraser disposed at the first end and second receptacle housing a second eraser disposed at the second end.

In addition the first receptacle may include the first rim that is disposed at the first end of the eraser holder, and the first rim may include both a first notch and a second notch opposite the first notch.

The second receptacle may include a second rim disposed at the second end of the eraser holder, the second rim having both a first notch and a second notch disposed opposite the first notch.

Thus, both the first and/or second rims may include a pair of notches, and each notch of the pair of notches of the eraser holder can be a female section.

Still further, the eraser cap may include a pair of tabs, and each tab of the pair of tabs may include a male section having a complementary shape to the female section.

In addition, the eraser cap may include a circular lip having a first tab extending therefrom and a second tab disposed opposite the first tab and extending from the circular lip.

The eraser holder may further include at least one projection adapted to fit into a channel of a writing instrument, thereby securing the eraser holder to the writing instrument.

In another example, an eraser assembly comprises an eraser holder having a first end, a second end disposed opposite the first end housing a first eraser, a second receptacle disposed at the second end housing a second eraser, a first rim disposed at a first end, the first rim having a first notch and a second notch, and a second rim disposed at the second end, the second rim also having a first notch and a second notch disposed opposite the first notch. The eraser assembly further comprises an eraser cap having a circular lip with a first tab extending therefrom and a second tab disposed opposite the first tab and also extending the from the circular lip, wherein the first and second tabs of the eraser cap engage the first and second notches, respectively, thereby securing the eraser cap to the eraser holder and enclosing one of the first and second erasers.

In yet another example, a writing instrument including an actuatable writing implement comprises an eraser assembly having at least one eraser, an eraser holder having a first rim including at least one notch and a bottom surface, the eraser being disposed in the eraser holder, and an eraser cap having at least one tab extending therefrom, the tab of the eraser cap engaging the notch of the eraser holder, thereby securing the cap to the eraser holder and enclosing the eraser. The writing instrument further comprises a barrel for housing a writing element capable of making erasable written markings, the eraser assembly being coupled to the barrel, undo plunger element capable of actuating an advancing mechanism for the writing implement contained within the barrel, the plunger element having a top surface. The bottom surface of the eraser holder engages the top surface of the plunger element, the bottom surface being in contact with and thus capable of advancing the plunger element and thereby actuating the advancing mechanism for the writing implement.

DETAILED DESCRIPTION OF THE DISCLOSURE

Figure 1:
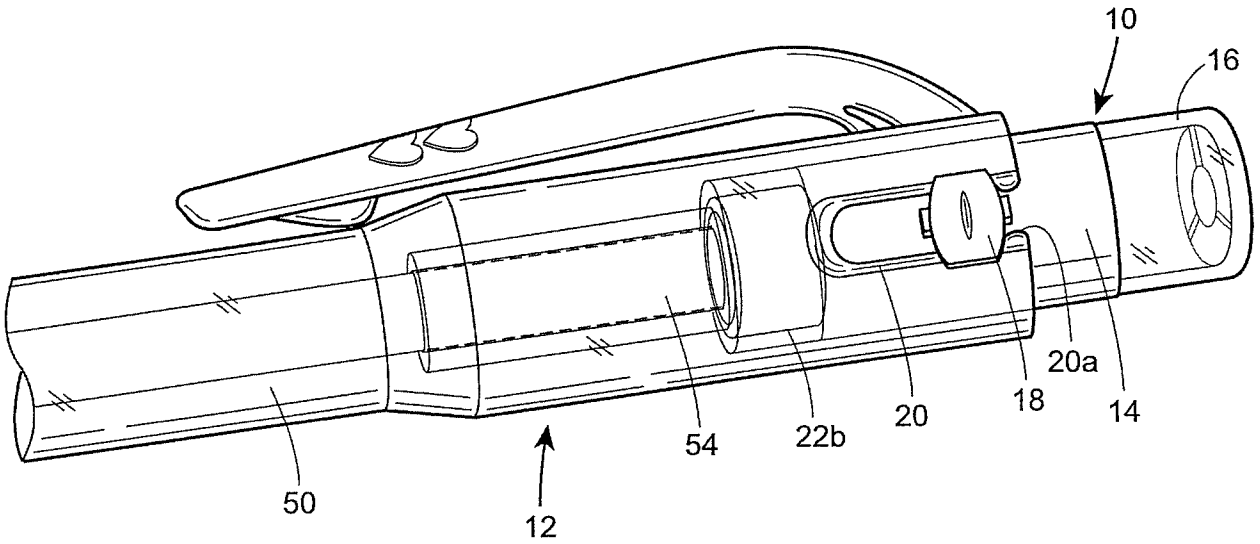
FIG. 1 is a top, perspective view of an eraser assembly disposed within a within a writing instrument.
Figure 2:
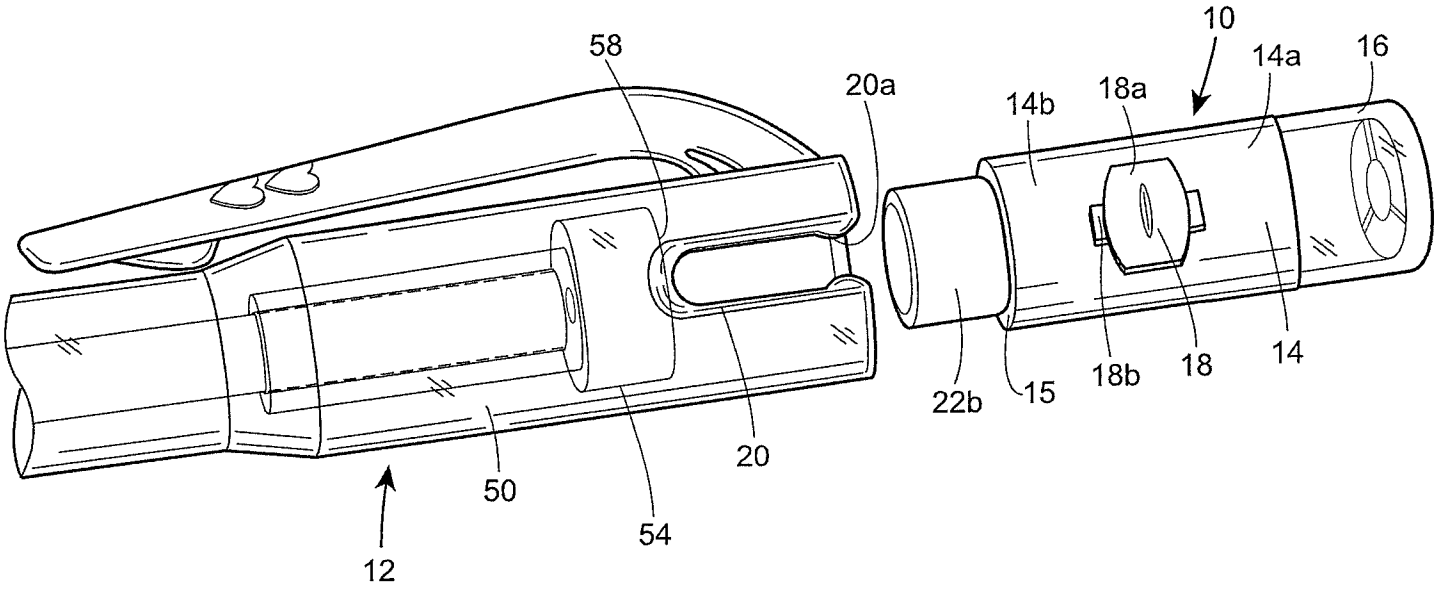
FIG. 2 is another top, perspective view of the eraser assembly, the eraser assembly removably detached from the writing instrument.
Figure 3:
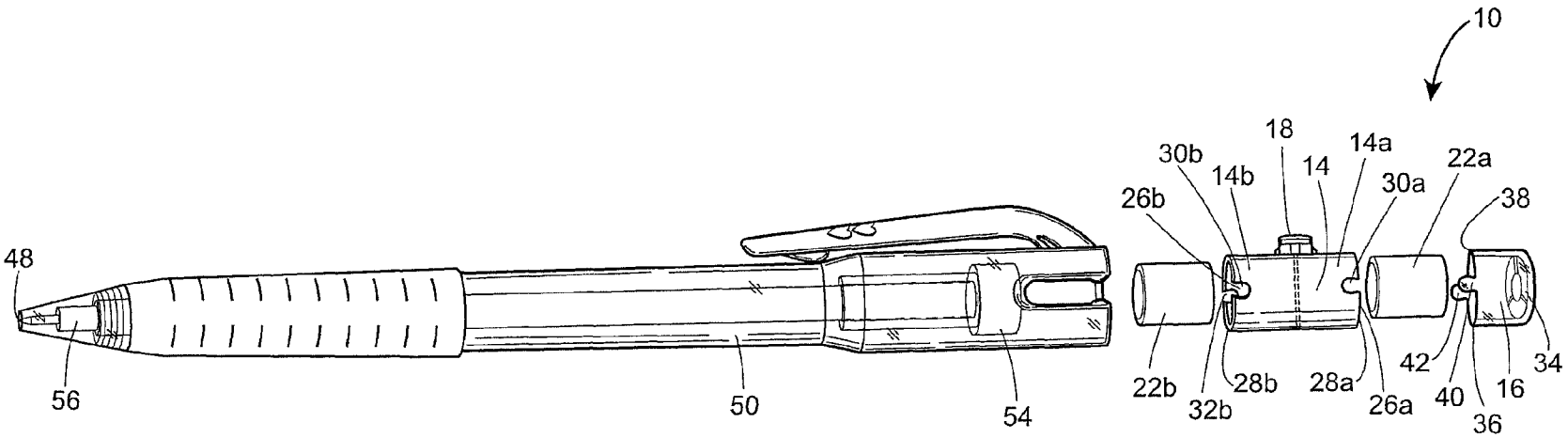
FIG. 3 is an exploded, side view of the eraser assembly relative to the writing instrument in which it may be disposed within.

Referring now to FIGS. 1-3, an eraser assembly 10 is illustrated. As illustrated in FIG. 1, the eraser assembly 10 is disposed within a writing instrument 12. Generally, the eraser assembly 10 includes an eraser holder 14 having a rim 28*a*, 28*b* (FIG. 3) including at least one notch 30*a*, 30*b* (FIG. 3), an eraser 22*a*, 22*b* (FIGS. 2 and 3) disposed in the eraser holder 14, and a cap 16 having at least one tab 40 (FIG. 3) extending therefrom. More specifically, and as explained in more detail below, the pair of tabs 40, 42 of the eraser cap 16 engage the notches 30*a* and second notch 32*a* (not shown), for example, of the eraser holder 14 to secure the cap 16 to the eraser holder 14 and enclose the eraser 22. While the illustrated embodiment includes a pair of tabs 40, 42 engaging a pair of notches 30*a*, 32*a*, a single tab 40 may alternatively engage a single notch 30*a*. The eraser holder 14 is generally cylindrical in shape and includes first and second openings as described in more detail below. In addition, while generally cylindrical in shape, the eraser holder 14 may also take the form of various other shapes, such as a square and a rectangle. While the eraser assembly 10 is shown as including two erasers 22*a*, 22*b*, a single eraser may alternatively be used.

Referring now to FIGS. 2 and 3, the eraser holder 14 includes a first end 14*a* and a second end 14*b* disposed opposite the first end 14*a*. A first receptacle 26*a* (FIG. 3) housing a first eraser 22*a* is disposed at the first end 14*a*, and a second receptacle 26*b* housing a second eraser 22*b* is disposed at the second end 14*b*. In addition, the first and second erasers 22*a*, 22*b*, like the eraser holder, are typically cylindrical in shape. While the erasers 22*a*, 22*b* are illustrated as being cylindrical in shape, they too can take the form of various other shapes, such as a square and a rectangle. A wall (not shown) can be disposed within the eraser holder 14 approximately mid-way between the first end 14*a* and the second end 14*b*. The wall divides the eraser holder 14 into the first and second receptacles 26*a*, 26*b*, allowing the first and second erasers 22*a*, 22*b* to be separate from and not in contact with each other when both erasers 22 are disposed within the eraser holder 14. Of course, a larger eraser 22 can be used if the wall is eliminated, but it is generally easier to replace and replenish relatively smaller erasers and so two erasers 22*a*, 22*b* are generally preferable.

As further illustrated in FIG. 3, the first receptacle 26*a* includes the first rim 28*a* disposed at the first end 14*a*, and the first rim 28*a* has a pair of notches, a first notch 30*a* and a second notch 32*a* (not shown), disposed opposite the first notch 30*a*. In a similar manner, the second receptacle 26*b* includes a second rim 28*b* disposed at the second end 14*b*, and the second rim 28*b* also has a pair of notches, a first notch 30*b* and a second notch 32*b*, disposed opposite the first notch 30*b*. Thus, each of the first and second rims 28*a*, 28*b* includes a pair of notches and each notch 30*a*, 30*b*, 32*a*, 32*b* includes a female section capable of receiving a notch 30*a*, 30*b*, 32*a*, 32*b*.

The eraser cap 16 includes a first end 34 and a second end 36, the second end 36 having a circular lip 38, and a pair of tabs extending from the circular lip 38. Each tab 40, 42 of the pair of tabs includes a male section having a complementary shape to the female section of each notch 30*a*, 30*b*, 32*a*, 32*b* of the first and second rims 28*a*, 28*b* of the eraser holder 14. More specifically, a first tab 40 extends from the circular lip 38, and a second tab 42 disposed opposite the first tab also extends from the circular lip 38.

When it is desired to attach the cap 16 to the eraser holder 14, the first and second tabs 40, 42 engage and snap into the first and second notches 30*a*, 30*b* disposed on the first end 14*a* of the eraser holder 14 for example, to secure the cap 16 to the eraser holder 14 and enclose the eraser 22. Alternatively, and in a similar manner, the cap 16 may be secured to the second end 14*b* of the eraser holder 14, such that the first and second tabs 40, 42 of the lip 38 of the cap 16 engage and snap into the first and second notches 30*b*, 32*b*, respectively. In either example, when the cap is secured to the eraser holder 14 and encloses the eraser 22, the eraser 22 picks up less dirt during use of the writing instrument, resulting in and continuously providing a cleaner, more aesthetically pleasing eraser 22.

Referring back to FIG. 2, the eraser holder 14 further includes at least one projection 18 that is adapted to fit into a slot or channel 20 of the writing instrument 12, thereby removably securing the eraser holder 14 of the eraser assembly 10 to the writing instrument 12. The projection 18 is disposed on an outside surface of the eraser holder 14, approximately mid-way between the first end 14*a* and the second end 14*b* of the eraser holder 14. In addition, as illustrated, the projection 18 is t-shaped, including a relatively wide top portion 18*a* having a flat-head shape and a relatively narrow bottom portion 18*b* providing a stem or neck for the top portion 18*a*, such that the top portion 18*a* is above and across the bottom portion 18*b* to form the t-shape. When the eraser holder 14 is secured to the writing instrument 12, the narrow bottom portion 18*b* of the t-shaped projection 18 is first received by a narrow portion 20*a* of the channel 20. This narrow portion 20*a* of the channel 20 first engages the bottom portion 18*b* of the projection 18, guiding and then allowing the top portion 18*a* of the projection 18 to snap into the channel 20. This snap fit and interaction between the projection 18 and the channel 20 can effectively releasably secure the eraser holder 14 to the writing instrument 12.

Figure 4:
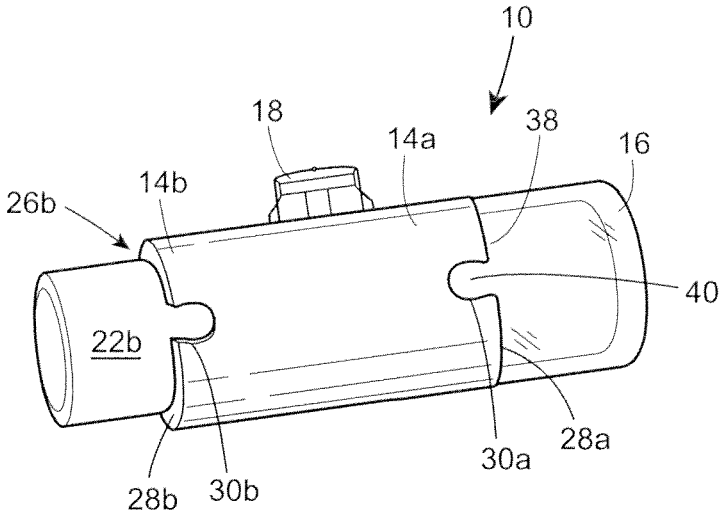
FIG. 4 is aside view of the eraser assembly with an eraser cap secured to an eraser holder.

Referring now to FIG. 4, the cap 16 is secured to the first end 14*a* of the eraser holder 14. More specifically, the first tab or male section 40 extending from the circular lip 38 of the cap 16 is inserted into the first notch 30*a* of the rim 28*a* of the eraser holder 14 to secure the eraser cap 16 to the eraser holder 14 and enclose the first eraser 22 therein. Although not shown in this figure, it is understood that when the first tab 40 is inserted in the first notch 30*a*, the second tab or male section 42 (FIG. 3) extending from the circular lip 38 of the cap is also simultaneously inserted into the second notch 32*a* (not shown) of the rim 28*a* of the eraser holder 14 to further secure the eraser cap 16 to the eraser holder 14. As mentioned above, while the illustrated embodiment includes a pair of tabs 40, 42 engaging a pair of notches 30*a*, 32*a*, a single tab 40 may alternatively engage a single notch 30*a*.

Figure 5:
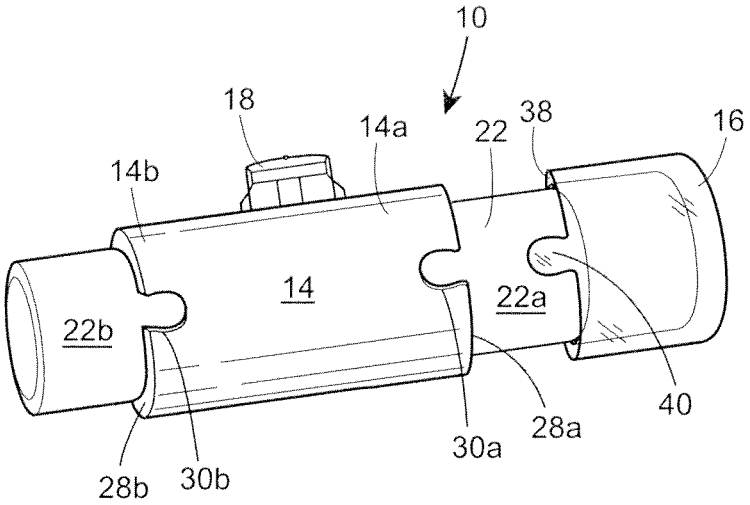
FIG. 5 is a side view of the eraser assembly with the eraser cap removed from the eraser holder.

Referring now to FIG. 5, the cap 16 is removed from the first end 14*a* of the eraser holder 14 by disengaging the pair of tabs 40, 42 from the pair of notches 30*a*, 32*a*, thereby allowing the first eraser 22*a* disposed within the receptacle 26*a* to be used, for example. In addition, the cap 16 can then alternatively be secured to the second end 14*b* of the eraser holder 14 in a manner similar to how the cap 16 was secured to the first end 14*a* of the eraser holder 14. In other words, the first and second tabs 40, 42 of the eraser cap can engage the first and second notches 30*b*, 32*b* of the second end 14*b* of the eraser holder, thereby securing the eraser cap 16 to the eraser holder 14 and enclosing the second eraser 22*b*.

The writing instrument 12 of FIGS. 1-3 includes a barrel 50 for housing a writing element capable of making erasable written markings. As illustrated in FIG. 1, the eraser assembly 10 is coupled to the barrel 50 via the projection 18. The writing instrument 12 further includes a plunger element 54 capable of actuating an advancing mechanism 56 (FIG. 3) for the writing implement 52 contained with the barrel 50, and the plunger element 54 includes atop surface 58 (FIG. 2). When the eraser assembly 10 is disposed within the writing instrument 12, the bottom surface or second rim 28*b* of the eraser holder 14 engages the top surface 58 of the plunger element 54, allowing the bottom surface 15 or second rim 28*b* to advance the plunger element 54 when the eraser assembly 10 is actuated by the consumer so as to advance the mechanism 56, permitting advancement and protraction of the writing implement 48.

The writing instrument 12 may be selected from writing instruments including but not limited to a mechanical pencil, an erasable ballpoint pen, an erasable marker, and a felt-tip pen. In addition, the writing element 52 can be a graphite pencil lead or a writing point in fluid communication with an ink reservoir containing an erasable ink. The writing point can be selected from writing points including but not limited to a ball point, a felt tip, an extruded plastic tip, and a porous nib for use in a capillary-action marker.

Most typically, the advancing mechanism is a conventional advancement mechanism selected from the group consisting of a ratchet mechanism and a clutch mechanism. More specifically, ratchet mechanisms may be used for both mechanical pencils and erasable pens. Clutch mechanisms are typically used for mechanical pencils.

As is well known, in ratchet-based pencils, lead is held in place by two or three small jaws inside a ring at a tip of the pencil. Jaws are controlled by pressing a button on the end or side of the pencil. When the button is pushed, the jaws move forward and separate, allowing the lead to advance. When the button is released, the jaws retract and the lead retainer or device that keeps the lead in place prevents the lead from either falling freely outward or riding back up into the barrel until the jaws recover their grip.

A typical clutch-based pencil is activated by pressing the eraser cap to open the jaws inside the tip, allowing the lead to freely drop through the barrel (or into it when retracting). Because the lead falls freely when the jaws are opened, its forward movement cannot be controlled except by externally halting its progress. This may be done by keep the tip of the pencil a few millimeters above a work surface, for example.

Regarding retractable ballpoint writing instruments containing an ink reservoir (i.e., pens and markers), springs within the ratchet mechanism allow it to retract. More specifically, the first spring, for example a ratchet spring, is located in the bottom half of the barrel (where the tip projects). The reservoir is put through this spring before its insertion through the open end of the barrel. On the other side of the reservoir, there is a spring that is located inside the upper half of the barrel. This spring, e.g., a button spring, is often connected to a screw and a clip, which are connected to the button at the end of the pen, allowing the button to be actuated to effect movement of the reservoir within the pen such that the writing point can be protracted, thereby facilitating its use.

While preferred embodiments of the present disclosure have been described above, variations may be made that are still within the scope of the appended claims.

What is claimed is:

1. An eraser assembly comprising:

at least one eraser;

an eraser holder having a first rim including at least one notch, the eraser being disposed in the eraser holder; and an eraser cap having at least one tab extending therefrom;

the tab of the eraser cap engaging the notch of the eraser holder, thereby securing the cap to the eraser holder and enclosing the eraser;

wherein the eraser holder comprises a first end, a second end disposed opposite the first end, a first receptacle housing a first eraser disposed at the first end, and a second receptacle adapted to house a second eraser disposed at the second end; and wherein the first receptacle includes the first rim, the first rim disposed at the first end of the eraser holder, the first rim having a first notch and a second notch disposed opposite the first notch.

2. The eraser assembly of claim 1, the second receptacle housing a second eraser disposed at the second end.

3. The eraser assembly of claim 2, wherein the second receptacle includes a second rim disposed at the second end of the eraser holder, the second rim having a first notch and a second notch disposed opposite the first notch.

4. The eraser assembly of claim 1, wherein the rim includes a pair of notches, and each notch of the pair of notches of the eraser holder includes a female section.

5. The eraser assembly of claim 4, wherein the eraser cap includes a pair of tabs, and each tab of the pair of tabs includes a male section having a complementary shape to the female section.

6. The eraser assembly of claim 1, wherein the eraser cap includes a circular lip having a first tab extending therefrom and a second tab disposed opposite the first tab and extending from the circular lip.

7. The eraser assembly of claim 1, wherein the eraser holder includes a projection adapted to fit into a channel of a writing instrument, thereby securing the eraser holder to the writing instrument.

8. An eraser assembly comprising:

an eraser holder having a first end, a second end disposed opposite the first end, a first receptacle disposed at the first end housing a first eraser, a second receptacle disposed at the second end housing a second eraser, a first rim disposed at a first end, the first rim having a first notch and a second notch, and a second rim disposed at the second end, the second rim having a first notch and a second notch disposed opposite the first notch; and an eraser cap having a circular lip with a first tab extending therefrom and a second tab disposed opposite the first tab and also extending from the circular lip;

the first and second tabs of the eraser cap engaging the first and second notches, respectively, thereby securing the eraser cap to the eraser holder and enclosing one of the first and second erasers.

9. The eraser assembly of claim 8, wherein the first and second tabs of the eraser cap are first and second male sections.

10. The eraser assembly of claim 9, wherein the first and second notches disposed on both the first and second rims of the eraser holder are first and second female sections that are adapted to receive the first and second male sections of the eraser cap.

11. A writing instrument including an actuatable writing implement comprising:

an eraser assembly having at least one eraser, an eraser holder having a first rim including at least one notch and a bottom surface, the eraser being disposed in the eraser holder, and an eraser cap having at least one tab extending therefrom, the tab of the eraser cap engaging the notch of the eraser holder, thereby securing the cap to the eraser holder and enclosing the eraser;

a barrel for housing a writing element capable of making erasable written markings, the eraser assembly being coupled to the barrel; and a plunger element capable of actuating an advancing mechanism for the writing implement contained within the barrel, the plunger element having a top surface;

the bottom surface of the eraser holder engaging the top surface of the plunger element, said bottom surface being in contact with and thus capable of advancing the plunger element and thereby actuating the advancing mechanism for the writing implement, wherein the eraser holder of the eraser assembly further comprises a first end, a second end disposed opposite the first end, a first receptacle disposed at the first end housing a first eraser, a second receptacle disposed at the second end housing a second eraser, a first rim disposed at a first end, the first rim having a first notch and a second notch and a second rim disposed at the second end, the second rim having a first notch and a second notch disposed opposite the first notch;

the eraser cap having a circular lip with a first tab extending therefrom and a second tab disposed opposite the first tab and also extending from the circular lip; and the first and second tabs of the eraser cap engaging one of the first and second notches, thereby securing the eraser cap to the eraser holder and enclosing one of the first and second erasers.

12. The writing instrument of claim 11, wherein the eraser holder includes a projection adapted to fit into a channel of the writing instrument, thereby securing the eraser holder to the writing instrument.

13. The writing instrument of claim 11, wherein the first and second tabs of the eraser cap are first and second male sections.

14. The writing instrument of claim 13, wherein the first and second notches disposed on both the first and second rims of the eraser holder are first and second female sections that are adapted to receive the first and second male sections of the eraser cap.

15. The writing instrument of claim 11, wherein the writing implement is selected from the group consisting of a mechanical pencil, an erasable pen, a ballpoint pen, an erasable marker, and a felt-tip pen.

16. The writing instrument of claim 11, wherein the writing element comprises a writing point selected from the group consisting of a graphite pencil lead and a writing point in fluid communication with an ink reservoir.

17. The writing instrument of claim 16, wherein the writing point can be selected from group consisting of a ball point, a felt tip, an extruded plastic tip, and a porous nib for use in a capillary-action marker.

18. The writing instrument of claim 11, wherein the advancing mechanism is selected from the group consisting of a ratchet mechanism and a clutch mechanism.

19. An eraser assembly comprising:

at least one eraser;

an eraser holder having a first rim including at least one notch, the eraser being disposed in the eraser holder; and an eraser cap having at least one tab extending therefrom;

the tab of the eraser cap engaging the notch of the eraser holder, thereby securing the cap to the eraser holder and enclosing the eraser;

wherein the eraser holder comprises a first end, a second end disposed opposite the first end, a first receptacle adapted to house a first eraser disposed at the first end, and a second receptacle housing a second eraser disposed at the second end; and wherein the second receptacle includes a second rim disposed at the second end of the eraser holder, the second rim having at least one notch.

* * * * *